United States Patent [19]

Barnes et al.

[11] Patent Number: 4,938,238

[45] Date of Patent: Jul. 3, 1990

[54] SMOKING ARTICLE WITH IMPROVED WRAPPER

[75] Inventors: Russell D. Barnes, Belews Creek, N.C.; Carmen P. Digrigoli, Canton, Ga.; Donald F. Durocher, Roswell, Ga.; Loyd G. Kasbo, Norcross, Ga.

[73] Assignee: R. J. Reynolds Tobacco Company, Winston-Salem, N.C.

[21] Appl. No.: 89,187

[22] Filed: Aug. 25, 1987

Related U.S. Application Data

[63] Continuation-in-part of Ser. No. 769,532, Aug. 26, 1985.

[51] Int. Cl.[5] ..... A24D 1/02

[52] U.S. Cl. ..... 131/365; 131/194

[58] Field of Search ..... 131/194, 195, 365, 359

[56] References Cited

U.S. PATENT DOCUMENTS

| | | |
|---|---|---|
| 198,075 | 12/1877 | Brisbane . |
| 439,004 | 10/1880 | Harris . |
| 1,581,619 | 4/1926 | Sulzberger . |
| 1,770,616 | 7/1930 | Kean . |
| 1,879,128 | 9/1932 | Desper . |
| 2,020,646 | 11/1935 | Hornstein . |
| 2,098,619 | 11/1937 | Finnell . |
| 2,471,116 | 5/1949 | Newberger . |
| 2,890,704 | 6/1959 | Lamm et al. . |
| 2,907,686 | 10/1959 | Siegel . |
| 2,998,012 | 8/1961 | Lamm et al. . |
| 3,049,449 | 8/1962 | Allegrini . |
| 3,106,210 | 10/1963 | Reynolds . |
| 3,220,418 | 11/1965 | Cohn . |
| 3,258,015 | 6/1966 | Ellis et al. . |
| 3,356,094 | 12/1967 | Ellis et al. . |
| 3,419,013 | 12/1966 | Calhoun et al. . |
| 3,516,417 | 6/1970 | Moses . |
| 3,586,005 | 6/1971 | Lippman et al. . |
| 3,773,053 | 11/1973 | Stephens, Jr. . |
| 3,911,932 | 10/1975 | Houck, Jr. et al. . |
| 3,943,941 | 3/1976 | Boyd et al. . |
| 4,044,777 | 8/1977 | Boyd et al. . |
| 4,044,778 | 8/1977 | Cohn . |
| 4,061,147 | 12/1977 | Falchi . |
| 4,286,604 | 9/1981 | Ehretsmann et al. . |
| 4,297,139 | 10/1981 | Beall et al. . |
| 4,326,544 | 4/1982 | Hardwick et al. . |
| 4,340,072 | 7/1982 | Bolt et al. . |
| 4,391,285 | 7/1983 | Burnett et al. . |
| 4,433,697 | 2/1984 | Cline et al. . |
| 4,461,311 | 7/1984 | Mathews et al. . |
| 4,474,191 | 10/1984 | Steiner . |
| 4,561,454 | 12/1985 | Guess . |
| 4,570,650 | 2/1986 | Sirota . |
| 4,574,821 | 3/1986 | Fischer et al. . |
| 4,615,345 | 10/1986 | Durocher . |
| 4,622,983 | 11/1986 | Mathews et al. . |
| 4,779,631 | 10/1988 | Durocher et al. ..... 131/365 |

FOREIGN PATENT DOCUMENTS

| | | |
|---|---|---|
| 117355 | 9/1984 | European Pat. Off. . |
| 174645 | 3/1986 | European Pat. Off. . |
| 212234 | 7/1986 | European Pat. Off. . |
| 23237 | 7/1986 | Iran . |
| 1185887 | 6/1967 | United Kingdom . |

*Primary Examiner*—V. Millin

*Attorney, Agent, or Firm*—Grover M. Myers; David G. Conlin

[57] ABSTRACT

The present invention relates to an improved wrapper for a smoking article haviing a combustible fuel element encircled by an insulating layer and a physically separate aerosol generating means as well as to smoking articles employing such wrappers. The wrapper encircles at least a portion of the insulating layer for the fuel element and comprises a permeable sheet material which during burning of the fuel provides a coherent layer to assist in controlling the amount of peripheral air to the fuel element during smoking.

Preferred smoking articles which employ the wrapper of the present invention have a short fuel element, a physically separate aerosol generating means including an aerosol forming material, an insulating material around the fuel element, a relatively long mouthend piece, and a combination of sheet materials as the wrapper comprising an innerwrap which after lighting of the fuel element burns away to a high permeability non-coherent ash and an outerwrap which upon lighting fuses to form a coherent ash which assists in controlling the amount of peripheral air to the fuel element during smoking.

42 Claims, 3 Drawing Sheets

SMOKING ARTICLE WITH IMPROVED WRAPPER

This application is a continuation-in-part of U.S. application Ser. No. 769,532, filed Aug. 26, 1985, which application is hereby incorporated by reference herein.

BACKGROUND OF THE INVENTION

The present invention relates to a wrapper for use in smoking articles as well as to smoking articles employing such wrapper. More specifically, the invention relates to an improved wrapper for a smoking article having a combustible fuel element and a physically separate aerosol generating means, the wrapper encircling at least a portion of the fuel element and comprising a permeable layer of sheet material which, during burning of the fuel element, provides a coherent layer to assist in controlling the amount of peripheral air to the burning fuel element.

Cigarette-like smoking articles have been proposed for many years. See for example, U.S. Pat. No. 2,907,686 to Siegel; U.S. Pat. Nos. 3,258,015 and 3,356,094 to Ellis et al.; U.S. Pat. No. 3,516,417 to Moses; U.S. Pat. Nos. 3,943,941 and 4,044,777 to Boyd et al.; U.S. Pat. No. 4,286,604 to Ehretsmann et al.; U.S. Pat. No. 4,326,544 to Hardwick et al.; U.S. Pat. No. 4,340,072 to Bolt et al.; U.S. Pat. No. 4,391,285 to Burnett; U.S. Pat. No. 4,474,191 to Steiner; and European patent application No. 117,355 (Hearn).

As far as the present inventors are aware, none of the foregoing smoking articles has ever realized any commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits and advantages associated with conventional cigarette smoking, without delivering considerable quantities of incomplete combustion and pyrolysis products.

In 1985, a series of foreign patents was granted or registered disclosing novel smoking articles capable of providing the benefits and advantages associated with conventional cigarette smoking, without delivering appreciable quantities of incomplete combustion or pyrolysis products. The earliest of these patents was Liberian Patent No. 13985/3890, issued Sept. 13, 1985. This patent corresponds to a later published European patent application, Publication No. 174,645, published Mar. 19, 1986.

SUMMARY OF THE INVENTION

The present invention relates to a unique wrapper especially suited for use as the wrapper for cigarette-like smoking articles having a combustible fuel element and a physically separate aerosol generating means. The wrapper, which at least partially encircles the fuel element, comprises one or more sheet materials which, during burning of the fuel element, provide a coherent layer to assist in controlling the amount of peripheral air to the burning fuel element, which in turn reduces the peak puff aerosol delivery, measured as wet total particulate matter, and provides a more uniform delivery of the aerosol over the life of the product. The present invention also relates to smoking articles which employ such wrapper materials.

In general, smoking articles utilizing the wrapper in accordance with the present invention normally include (1) a fuel element; (2) an air permeable resilient jacket of insulating materials, e.g., glass fibers, which circumscribe at least a portion of the fuel element, (3) a physically separate aerosol generating means including an aerosol forming substance; and (4) an optional aerosol delivery means in the form of a mouthend piece. Preferably the smoking article is of the cigarette type, which utilizes a short, i.e., less than about 30 mm long, preferably carbonaceous, fuel element, and the aerosol generating means is in a conductive heat exchange relationship with the fuel element.

Controlling the amount of peripheral air which reaches the fuel element of such articles during smoking is believed to be important for a number of reasons. It has been discovered that controlling the amount of air flow to the burning fuel element through the wrapper of the present invention allows one to control the amount of aerosol delivered as WTPM in peak puffs as compared with a smoking article having the same structure but without the wrapper of the invention. Such control is generally by way of reducing the WTPM in peak puff delivery by at least about 20%, preferably by at least about 35%, most preferably by at least about 50%. By reducing the peak deliveries, one is able to provide the user with a more uniform delivery of aerosol components over the life of the article. Moreover, uniform aerosol delivery helps to reduce any undesirable impact or effect in any one puff due to non-uniform delivery of one or more of the aerosol components.

A reduction in the aerosol delivery in peak puffs also serves, in most cases, to increase the overall puff count while maintaining the total desired WTPM, by increasing the life of the fuel source. In other words, if one regulates or limits the amount of peripheral air which reaches the burning fuel element, one ultimately has a degree of control over how fast, how hot, and how long that fuel element will burn, which controls the rate at which the fuel element drives the system, i.e. produces aerosol from the aerosol generating means.

Another advantage of controlling the amount of peripheral air to the burning fuel element is the reduction in the gas temperature which reaches the aerosol generating means. A reduction in the gas temperature helps to reduce thermal degradation and/or pyrolysis of the aerosol components used in the smoking article.

Other advantages of controlling the amount of peripheral air to the burning fuel element in such smoking articles include the reduction in temperature of the aerosol as perceived by the user as well as a reduction in the temperature of the fuel end of the smoking articles which reduces the chance of accident if the article is dropped.

These and other advantages are obtained by the use of a wrapper which provides a coherent layer which assists in controlling the amount of peripheral air to the burning fuel element, and which provides a more uniform delivery of aerosol over the life of the article.

As noted above, the wrapper of the present invention encircles at least a portion of the fuel element and preferably, the jacket of insulating material which normally encircles the fuel element. In embodiments utilizing a layer of insulating material wherein there is no wrapper or where it burns away from or is absent from the jacketed fuel element, maximum heat transfer is achieved because air flow to the fuel element is not restricted. However, the wrapper of the present invention is designed or engineered to remain wholly or partially intact upon exposure to heat from the burning fuel element. Such wrappers provide the opportunity to restrict air flow to the burning fuel element, thereby controlling the temperature at which the fuel element burns and the subsequent heat transfer to the aerosol generating means.

The wrapper preferably comprises one or more sheet materials, at least one of which contains a sufficient amount of inorganic material, normally present as a continuous or contiguous layer or as an interconnected, entangled or overlapping matrix, which provides a permeable coherent layer during burning of the fuel element to assist in controlling (normally reducing) the amount of peripheral air to the burning fuel element. The wrapper also serves, at least in part, to maintain the integrity of the various components of the article, especially when the wrapper is used to wrap other components of the article, such as the preferred optional tobacco jacket. Preferred wrappers provide an ash which has the appearance of ash produced by a conventional cigarette.

In certain preferred embodiments, the wrapper of the present invention comprises a combination of sheet materials including an innerwrap, which upon lighting of the fuel element burns to produce a high permeability non-coherent ash (similar to that produced by ordinary cigarette paper), and an outerwrap which upon lighting of the fuel element forms a coherent ash which assists in controlling the amount of peripheral air to the burning fuel element and which maintains the integrity of the various components of the article during smoking. This combination of sheet materials thus provides advantages of high strength and integrity, while imparting burn properties similar to those of conventional cigarettes.

Preferred smoking articles employing the wrapper of the present invention are capable of delivering at least 0.6 mg of aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal(sec) ($cm^2$) (°C/cm), of less than about 0.05, preferably less than about 0.02, most preferably less than about 0.005. See, *Hackh's Chemical Dictionary* 672 (4th ed., 1969) and Lange's *Handbook of Chemistry* 10, 272–274 (11th ed., 1973).

Smoking articles employing the wrapper material of present invention are described in greater detail in the accompanying drawings and the detailed description of the invention which follow.

DETAILED DESCRIPTION OF THE PREFERRED EMBODIMENTS

In accordance with the present invention, there is provided a unique wrapper for use in smoking articles, which wrapper assists in controlling the amount of peripheral air to the burning article. The wrapper is particularly suited for smoking articles having a combustible fuel element encircled at least in part by an air permeable insulating layer and a physically separate aerosol generating means such as those articles described in the above-referenced EPO Publication No. 174,645 as well as in EPO Publication No. 212,234.

Figure 4:
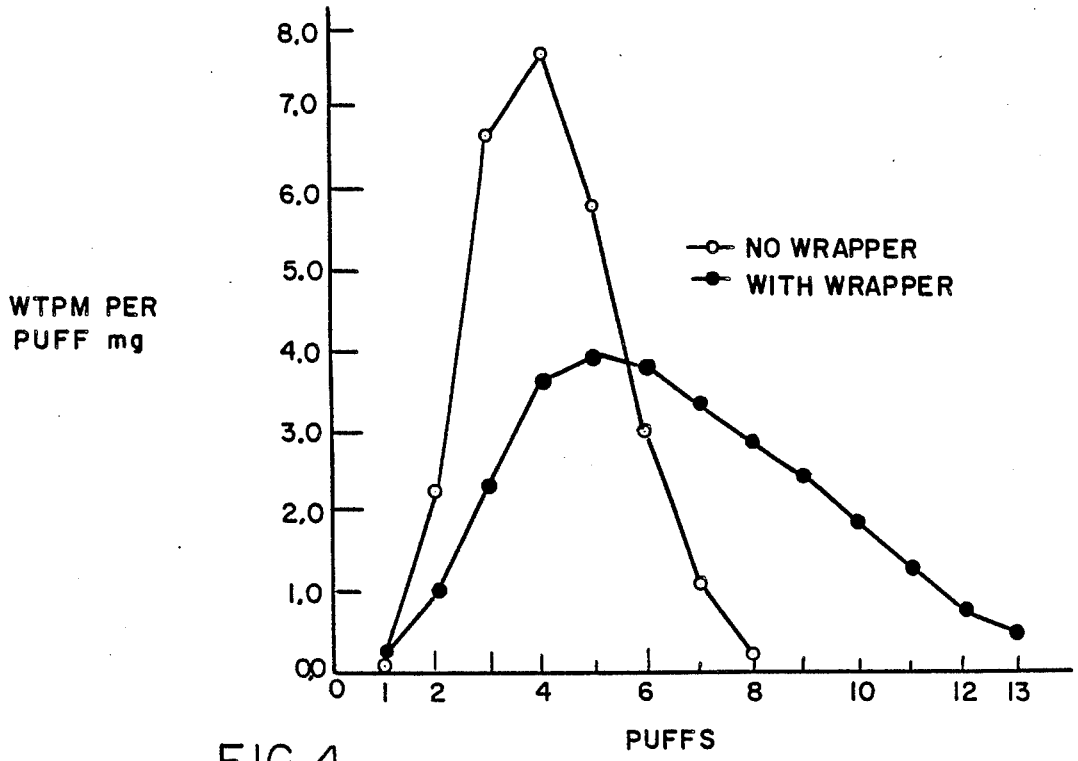
FIG. 4 illustrates a typical WTPM delivery curve which shows the reduction of WTPM in peak puffs when smoking articles employ the wrapper of the present invention.

The wrapper of the present invention reduces the peak puff aerosol delivery when measured as WTPM by at least about 20% when compared to a smoking article having the same structure but without the wrapper of the present invention when both articles are smoked under so-called human conditions which consist of 50 ml puff volumes of 2 second duration, separated by 28 seconds of smolder, for at least about six puffs. Preferably the peak puff aerosol delivery is reduced by at least about 35%, most preferably by at least about 50%. FIG. 4 illustrates a typical WTPM delivery curve with and without the wrapper of the present invention. The sharp peak which appears for insulated fuel element smoking articles constructed without a wrapper, or with a conventional cigarette paper wrapper, shows that most of the aerosol in such articles is delivered in the middle puffs, namely puffs 3–6. When the wrapper of the present invention is employed with such articles, the delivery profile is more uniform and generally extends the number of puffs of the article.

As will be appreciated by the skilled artisan, the degree of control provided by the coherent layer in accordance with the present invention which is required in order to reduce the WTPM in peak puffs by the desired amount is system-dependent and will vary with a number of factors. Such factors include the amount of energy generated by the fuel source, the heat sink effect due to the particular aerosol generating means employed, the amount of aerosol former as well as the physical characteristics of any substrate material used to carry the aerosol former, the moisture content of the aerosol former, and the type and thickness of the insulating jacket which circumscribes the fuel element.

Reduction in the delivery of peak puffs with the wrapper of the present invention for a given system may be achieved in a number of ways with a variety of materials. In general, reduction in the delivery in peak puffs may be achieved by influencing or controlling the amount of peripheral air which reaches the burning fuel element. The wrapper material of the present invention assists in controlling the amount of peripheral air which reaches the burning fuel element by providing a coherent layer which at least partially encircles the fuel element, or more preferably the air permeable insulating layer which normally encircles the fuel element, and which helps to control the burn rate of the fuel element.

In accordance with one aspect of the present invention, the wrapper may comprise a variety of non-burning materials such as aluminum foil, mica-type papers, high temperature plastic films such as Kapton and Nomex type materials, and the like. Such materials may be provided with a predetermined number of holes or perforations and used to wrap at least a portion of the fuel element or its circumscribing insulating jacket. The number, size and arrangement of the holes will vary depending on the particular system and the desired reduction in WTPM of peak puffs for that system. Such materials provide the coherent layer which assists in controlling the amount of peripheral air which reaches the burning fuel element, which in turn, reduces the WTPM of peak puffs and allows a more uniform delivery of aerosol to the user over the life of the article.

In accordance with another aspect of the present invention the wrapper comprises cigarette-type or similar paper(s) which are chemically treated with an inorganic component to provide a burn pattern which produces the coherent layer which assists in controlling the amount of peripheral air to the burning fuel element. For example, waterglass, or other inorganic silicate materials may be applied to conventional cigarette paper in a predetermined pattern such that when the treated cigarette paper burns upon lighting of the fuel element, the ash which is left behind provides a coherent layer which reduces the WTPM in peak puffs by the desired amount. The pattern may be in any of a variety of forms including a checkerboard pattern, grids, bars, and the like. The pattern to be used may be determined by the skilled artisan from the disclosure herein, e.g., by testing smoking articles with and without the pattern under consideration, determining the reduction in peak puff delivery, and adjusting the area and/or design of the pattern of treated area to achieve the desired reduction in WTPM.

For the above-described embodiments, the skilled artisan will appreciate that the degree of openness of the coherent layer provided by the holes, perforations or chemical treatment may vary broadly depending on the reduction in WTPM in peak puffs desired for any particular system. If, for example, one wishes to reduce the WTPM of peak puffs by at least about 50%, then the degree of openness of the coherent layer provided by the article during smoking would be substantially less than the degree of openness required when only a 20% reduction of WTPM in peak puffs is desired. Thus, one would provide fewer holes or apply more waterglass to the paper(s) when a reduction of 50% is desired.

In accordance with yet another aspect of the present invention the wrapper comprises a cellulose based paper wrapper which contains a sufficient amount of inorganic material, normally in an interconnected, entangled, or overlapping web, to provide a coherent ash which not only helps maintain the integrity of the article, but which assists in controlling the amount of peripheral air to the burning fuel element to provide the desired reduced WTPM in peak puffs. Preferably, this coherent ash, inorganic content paper is employed in an innerwrap/outerwrap combination around the insulating layer, in which the inorganic content paper is used as the outerwrap which encircles both the insulating layer and the preferred tobacco jacket around the aerosol generating means.

In this preferred embodiment, the innerwrap may be a conventional cigarette paper which, upon lighting of the fuel element, burns to produce a highly permeable non-coherent ash. Such papers, generally, contain predominantly cellulose fibers and may include fillers such as calcium carbonate and clay and one or more additives to enhance burn properties, appearance or the like. The preferred paper is an experimental paper obtained from Kimberly-Clark Corporation designated P780-63-5.

The coherent ash producing outerwrap is of more critical composition and preferably comprises about 40 to 80 percent, preferably 65 to 70 percent cellulose fibers by weight. These cellulose fibers are preferably wood pulp but may comprise flax or other natural cellulose fibers. The outerwrap also preferably contains about 10 to 30 percent, more preferably 15 to 25 percent by weight of high temperature resistant glass microfibers as the inorganic component of the wrapper. Such microfibers will preferably have a diameter generally in the range of from about 0.7 to 5.0 microns and will be able to withstand temperatures in excess of 700° C. while maintaining significant strength properties. The outerwrap composition also preferably contains a mineral filler in the range of from about 10 to 30 percent by weight, which preferably includes 5 to 15 percent attapulgite clay and up to 10 percent titanium dioxide. While the preferred filler is attapulgite clay, other fillers such as fumed alumina also may be used as well. Preferably the outer sheet will also contain titanium dioxide in an amount in the range of from about 2 to 8 percent by weight, more preferably about 4 to 6 percent by weight to improve the ash appearance. The composition will also preferably contain a burn additive, such as potassium succinate, in the range of from about 0 to 10 percent by weight, preferably between about 3 to 7.5 percent, most preferably between about 4.5 and 5.5, depending on factors such as the permeability and density of the combination of wrappers.

Alternatively, the burn additive may be part of the composition of the innerwrap. As with the outerwrap, the amount of burn additive which may be employed in the innerwrap may range broadly. In general, it may range between 0 and 10 percent by weight, preferably between about 1.0 and 6.0, most preferably between about 2.5 and 4.5.

In certain preferred embodiments, the burn additive may be employed in both the inner and outer wrapper compositions with the total for both compositions in the range of 3 to 10 percent by weight. This construction will permit rapid burnback of the inner wrapper which will ash quickly, generally in the first 1 to 3 puffs.

Burn enhancers which may be used in practicing the present invention include alkali metal salts such as sodium or potassium citrate or succinate but may include other known burn enhancers that act to modify the burn properties of the resulting sheet.

While, as noted above, the inner wrapper requirements can be met with conventional cigarette papers, the cited above for the outer wrapper are preferably met by an experimental paper composition obtained from Kimberly-Clark Corporation, designated P1768-65-2.

In general, the preferred outerwrap composition of papers such as P1768-65-2 is:

| | |
|---|---|
| Basis Weight in g/m$^2$ | Preferably 35 to 45 g/m$^2$ with about 40 g/m$^2$ most preferred |
| Hydrated bleached kraft pulp | Preferably 40 to 80%, with 64 to 70% most preferred |
| Glass fiber | Preferably 10 to 30%, with 15 to 25% most preferred |
| Mineral filler | 10–30% (preferably composed of 5–15% attapulgite clay and 0–10% titanium dioxide) |
| Burn additive | 3–10% (preferably about 3 to 7.5% potassium succinate) |

The attapulgite clay of choice is Attagel 40 from Englehart industries. The glass fiber component is preferably a high temperature resistant microglass fiber designated Evans 606.

Preferably the glass/clay components should be in ratio of about 2:1 to maintain optimum ash integrity. If glass is omitted, the ash is flaky; while if the glass content is increased, the ash shrinks too much and is, as a consequence, unappealing in appearance.

When present, $TiO_2$ is not believed to function as a typical opacifying pigment, but instead serves in an unknown chemical fashion to provide the desired light gray ash color. When it is omitted, the ash is black and unappealing. If such black ashes are subsequently mixed with the corresponding amount of $TiO_2$, the resultant gray color is noticeably darker than that observed when $TiO_2$ is present initially. This suggests the unexpected chemical effect mentioned above.

The requisite mechanical strength of the outerwrap ash may be achieved by substituting other glass-like fibers for glass microfibers. Of particular interest is a phosphate fiber material, e.g., calcium sodium metaphosphate, such as that manufactured by the Monsanto Co., St. Louis, Mo. Because of its high melting point of 740° C., the stable permeability of ashes incorporating that fiber will be extended to this temperature range.

Other high temperature microfibers that may be employed include Fiberfrax TM (aluminum silicate), silicon carbide, calcium sulfate, and carbon fibers. Certain high temperature resistant organic fibers may also be used such as Nomex TM or Kevlar TM aromatic polymides as well as PBI (polybenzimidazole) fibers.

The burn additive, preferably potassium succinate, also contributes to the resultant ash strength. The final ash (after burning off the cellulose portion) can be as low as 20% by weight of the initial paper weight without seriously impinging on the coherence, strength and permeability requirements.

Production of this coherent ash paper may be made using conventional papermaking techniques as will be known to those skilled in this art. In general, the sheet components are mixed with water and the slurry applied to a papermaking wire where the water is removed and the sheet dried by passing over and between heated rolls. Other web forming techniques such as airforming may also be used if desired.

The thickness or caliper of the paper layers in the preferred innerwrap/outerwrap combination embodiment will normally be similar to that of conventional cigarette papers. In general, the caliper of the innerwrap preferably ranges between about 0.01 and 0.10 mm, and preferably between about 0.060 mm and about 0.070 mm. The caliper of the outerwrap, which contains the microglass fiber component, generally has a caliper which ranges between about 0.01 mm and 0.10 mm, and preferably between about 0.065 mm and about 0.075 mm.

In the preferred innerwrap/outerwrap combination, both wrappers should extinguish before the fuel element is completely exhausted and should preferably "go out" after three or four puffs to yield the ash appearance of a newly lit conventional cigarette (about 5–8 mm in length).

Preferred cigarette-type smoking articles which may employ the wrapper of the present invention are described in the following patent applications:

| Applicants | Ser. No. | Filed |
|---|---|---|
| Sensabaugh et al. | 650,604 | September 14, 1984 |
| Shannon et al. | 684,537 | December 21, 1984 |
| Banerjee et al. | 939,203 | December 8, 1986 |
| Sensabaugh et al. | EPO 85111467.8 | September 11, 1985 (published 3/19/86) |
| Banerjee et al. | EPO 86109589.1 | September 14, 1986 |

-continued

| Applicants | Ser. No. | Filed |
|---|---|---|
| | | (published 3/4/87) |

the disclosures of which are hereby incorporated by reference.

Figure 1:
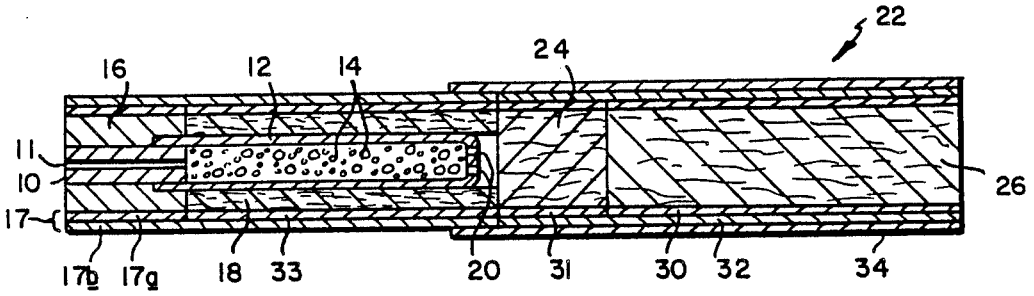
FIG. 1 is a longitudinal view of one preferred smoking article which may employ the wrapper of the present invention.
Figure 1A:
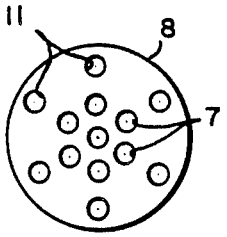
FIG. 1A illustrates, from the lighting end, a preferred fuel element passageway configuration.

One such preferred cigarette-type smoking article is set forth in FIG. 1 accompanying this specification. Referring to FIG. 1 there is illustrated a cigarette-type smoking article having a small carbonaceous fuel element 10 with a plurality of passageways 11 therethrough, preferably about thirteen arranged as shown in FIG. 1A. This fuel element is formed from an extruded mixture of carbon (preferably from carbonized paper), sodium carboxymethyl cellulose (SCMC) binder, $K_2CO_3$, and water, as described in the above referenced patent applications.

The periphery 8 of fuel element 10 is encircled by a resilient jacket of insulating fibers 16, such as glass fibers, which in turn, is circumscribed by wrapper 17, comprising innerwrap 17*a* and the coherent ash outerwrap 17*b*.

A metallic capsule 12 overlaps a portion of the mouthend of the fuel element 10 and encloses the physically separate aerosol generating means which contains a substrate material 14 which carries one or more aerosol forming materials. The substrate may be in particulate form, in the form of a rod, or in other forms as detailed in the above referenced patent applications. Two slit-like passageways 20 are provided at the mouth end of the capsule to permit the aerosol to be delivered to the user.

Capsule 12 is circumscribed by a jacket of tobacco 18 which is circumscribed by a paper layer 33 and by coherent ash outerwrap 17*b*. In other words, in this preferred embodiment, the coherent ash outerwrapper 17*b* is used to wrap both the insulating jacket 16 and the tobacco jacket 18.

At the mouth end of tobacco jacket 18 is a mouthend piece 22, preferably comprising a segment of a folded sheet of tobacco 24 and a segment of folded, meltblown thermoplastic fibers 26 through which the aerosol passes to the user. The remainder of the article, i.e. other than the fuel element, or portions thereof which are wrapped with the wrapper material of the present invention, is overwrapped with one or more layers of cigarette papers 30–34.

Upon lighting the aforesaid embodiment, the fuel element burns, generating the heat used to volatilize the tobacco flavor material and any additional aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as was common in previous thermal aerosol articles.

Because the tobacco flavor material and any additional aerosol forming substances are physically separate from the fuel element, they are exposed to substantially lower temperatures than are generated by the burning fuel, thereby minimizing the possibility of thermal degradation.

In preferred embodiments, the short carbonaceous fuel element, heat conducting member, insulating means and the wrapper material of the present invention cooperate with the aerosol generator to provide a system which is capable of producing substantial quantities of aerosol on virtually every puff. The close proximity of the fire cone to the aerosol generator after a few puffs, together with the insulating means, results in high heat delivery both during puffing and during the relatively long period of smolder between puffs.

Figure 2:
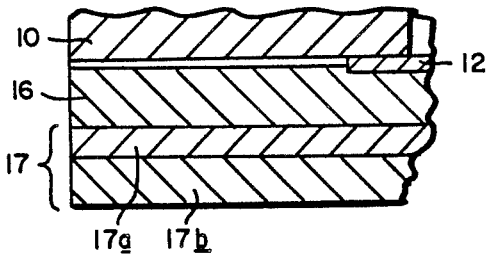
FIG. 2 illustrates a broken away unlit version of the fuel end of a smoking article employing an innerwrap-/outerwrap combination as the wrapper.
Figure 3:
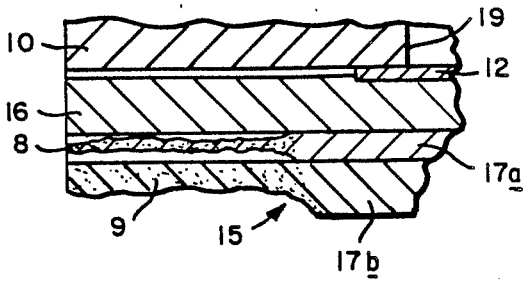
FIG. 3 illustrates a broken away freshly lit version of the article illustrated in FIG. 2.

Referring to FIG. 2, an unlit version of a smoking article of the type described above employing the preferred innerwrap/outerwrap combination is shown, with the thickness or caliper of the wrapper layers being exagerated. Here the carbon fuel source 10 and its surrounding jacket of insulating fibers 16 are shown overwrapped by an inner wrapper 17*a* and an outer wrapper 17*b*. In FIG. 3 a freshly lighted version of the same article is shown, i.e., shortly after the article has been lit at the end and puffed 2 or 3 times so that a substantial portion of the fuel source 10 is now glowing and at a temperature of some 800°–900° C. While the jacket of insulating fibers 16 remains largely unchanged in size except for some shrinkage adjacent to fuel element 10, both the innerwrap 17*a* and outerwrap 17*b* have burned back to about the junction 19 of the capsule 12 and fuel element 10 and have extinguished. The burnt-out region 8 of inner wrapper 17*a* has been transformed to essentially non-coherent inorganic ash, which is highly porous; the corresponding region of outer wrapper 17*b* has been transformed into a strong, coherent gray-white ash 9, which serves to contain and obscure not only the loose ash of region 8 but the jacket of insulating fibers 16. Ash 9 is preferably of such strength and coherence that it resists dislodgement when the smoking article is vigorously tapped or struck against an ash tray—thus avoiding the familiar untidiness associated with conventional burning cigarettes. Visually, ash 9 closely resembles the ash appearance of a typical cigarette, which is a desirable esthetic quality. (This is enhanced by the presence of a characteristic char line 15 between ash 9 and the uncombusted portion of outer wrapper 17*b*.) In addition, ash 9 exhibits controlled permeability that is different from the ash obtained from conventional cigarette wrappers. This property provides "throttling" to the combustion rate of fuel element 10 as the smoking article is puffed from initial lighting (FIG. 3) to exhaustion of said element.

It is further preferred that the required permeability be achieved in the outer wrapper alone. That is, the ash (if any) of the inner wrapper should not offer any appreciable resistance to the flow of air when compared to that of the outer wrapper ash.

Both wrappers preferably extinguish shortly after the smoking article is lighted and should preferably "go out" after the first 3 or 4 puffs to yield the ash appearance of a newly lit cigarette (5–8 mm in length). During the brief combustion of the cellulose components comprising the inner and outer wrappers, a small fraction of the products of this combustion may be detected by a discerning smoker as contributing certain "burning paper" flavor notes when the smoking article is first puffed. These possibly objectionable flavor notes can be ameliorated by incorporating small quantities of well-known flavorants (e.g., menthol, vanillin) into the wrapper materials.

Alternatively, it is also possible to modify the combustion process to yield less acrid smoke by incorporating a few percent (for example, 1 to 2% by weight based on the total wrapper) of certain reagents. These reagents include known wrapper additives of two classes. The first includes solid oxidizers such as potassium nitrate or potassium chlorate, and the other includes low melting, nonvolatile Lewis acids, such as monoammonium phosphate, polymeric phosphoric acids $(HOP_3)_x$, and their ammonium salts. The second class modifies the odor from high acridity to a pleasant, sweet odor often associated with burning simple sugars.

In general, the combustible fuel elements which may be employed in preferred embodiments have a diameter no larger than that of a conventional cigarette (i.e., less than or equal to 8 mm), and are generally less than about 30 mm long. Advantageously the fuel element is about 15 mm or less in length, preferably about 10 mm or less in length. Advantageously, the diameter of the fuel element is between about 2 to 8 mm, preferably about 4 to 6 mm. The density of the fuel elements employed herein may generally range from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used, especially where a minor amount of tobacco, tobacco extract, or a nonburning inert filler is used. Preferred fuel elements are described in greater detail in the above referenced patent applications.

The aerosol generating means used in practicing this invention is physically separate from the fuel element. By physically separate is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., as well as SGL carbon, available from Calgon, Corp. Other suitable materials include inorganic solids, such as ceramics, glass, alumina, vermiculite, clays such as bentonite, or mixtures thereof. Carbon and alumina substrates are preferred.

An especially useful alumina substrate is a high surface area alumina (about 280 $m^2/g$), such as the grade available from the Davison Chemical Division of W. R. Grace & Co. under the designation SMR-14-1896. This alumina (−14 to +20 U.S. mesh) is preferably sintered for about one hour at an elevated temperature, e.g., greater than 1000° C., preferably from about 1400° to 1550° C., followed by appropriate washing and drying, prior to use.

The aerosol forming substance or substances used in the articles of the present invention must be capable of forming an aerosol at the temperatures present in the aerosol generating means upon heating by the burning fuel element. Such substances preferably are non-tobacco, non-aqueous aerosol forming substances and are composed of carbon, hydrogen and oxygen, but they may include other materials. Such substances can be in solid, semi-solid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or polycarboxylic acids, such as methyl stearate, dimethyl dodecandioate, dimethyl tetradecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed by any known technique on or within the substrate in a concentration sufficient to permeate or coat the material. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 140 mg, and preferably from about 40 mg to about 110 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed within the mouthend piece, or in the optional tobacco charge.

One particularly preferred aerosol generating means comprises the aforesaid alumina substrate containing spray dried tobacco extract, levulinic acid or glucose pentaacetate, one or more flavoring agents, and an aerosol former such as glycerin.

A charge of tobacco may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting material employed as the container for the aerosol generating means is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve the desired degree of heat transfer.

As shown in the embodiment illustrated in FIG. 1, the heat conducting member preferably contacts or overlaps the rear portion of the fuel element, and may form the container or capsule which encloses the aerosol producing substrate of the present invention. Preferably, the heat conducting member extends over no more than about one-half the length of the fuel element. More preferably, the heat conducting member overlaps or otherwise contacts no more than about the rear 5 mm, preferably 2–3 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members or layer employed in the preferred smoking articles are preferably formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 1, different materials may be used to insulate these two components of the article.

The currently preferred insulating materials, paticularly for the fuel element, are ceramic fibers, such as glass fibers. Preferred glass fiber are experimental materials produced by Owens—Corning of Toledo, Ohio under the designations 6432 and 6437, which have softening points of about 650° C. Other suitable insulating materials, preferably non-combustible inorganic materials, may also be used.

In the most preferred embodiments, the fuel and aerosol generating means will be attached to a mouthend piece, although a mouthend piece may be provided separately, e.g., in the form of a cigarette holder for use with disposable fuel/aerosol generating cartridges. The mouth end piece channels the vaporized aerosol forming substance into the mouth of the user. Due to its length, about 35 to 50 mm, it also keeps the heat from the fire cone away from the mouth and fingers of the user, and provides some cooling of the hot aerosol before it reaches the user.

Suitable mouthend pieces should be inert with respect to the aerosol forming substances, should offer minimum aerosol loss by condensation or filtration, and should be capable of withstanding the temperature at the interface with the other elements of the article. Preferred mouthend pieces include the tobacco sheet—meltblown fiber combination of FIG. 1 and the mouth end pieces disclosed in European Patent Publication Nos. 174,645 and 212,234.

To maximize aerosol delivery, which otherwise could be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 30637-801-12001 manufactured by Ecusta of Pisgah Forest, NC, and Kimberly-Clark Corporation's papers P850-186-2, P1487-184-2 and P1487-125.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., Mut. Res., 31: 347–364 (1975); Nagao et al., Mut. Res., 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The use of the wrapper material of the present invention in cigarette-like smoking articles will be further illustrated with reference to the following examples which will aid in the understanding of the present invention, but which are not to be construed as a limitation thereof. All percentages reported herein, unless otherwise specified, are percent by weight. All temperatures are expressed in degrees Celsius and are uncorrected.

EXAMPLE I

A smoking article of the type illustrated in FIG. 1 was made in the following manner.

A. Fuel Source Preparation

The fuel element (10 mm long, 4.5 mm o.d.) having an apparent (bulk) density of about 0.86 g/cc, was prepared from carbon (90 wt. percent), SCMC binder (10 wt. percent) and $K_2CO_3$ (1 wt. percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated to a temperature of up to about 850° C. to remove volatiles.

After cooling again under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon: 1 part binder), 1 wt. percent $K_2CO_3$, and sufficient water to make a stiff, dough-like paste.

Fuel elements were extruded from this paste having seven central holes each about 0.022 in. in diameter and six peripheral holes each about 0.01 in. in diameter. The web thickness or spacing between the central holes was about 0.008 in. and the average outer web thickness (the spacing between the periphery and peripheral hole) was 0.019 in. as shown in FIG. 1A.

These fuel elements were then baked-out under a nitrogen atmosphere at 900° C. for three hours after formation.

B. Spray Dried Extract

A blend of flue cured tobaccos were ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-90° C.

C. Preparation of Sintered Alumina

High surface area alumina (surface area of about 280 $m^2/g$) from W. R. Grace & Co., having a mesh size of from −14 to +20 (U.S.) was sintered at a soak temperature of about 1400° C. to 1550° C. for about one hour, washed with water and dried. This sintered alumina was combined, in a two step process, with the ingredients shown in Table I in the indicated proportions:

TABLE I

| | |
|---|---|
| Alumina | 68.0% |
| Glycerin | 19.0% |
| Spray Dried Extract | 7.0% |
| Flavoring Package | 6.0% |
| Total: | 100.0% |

The flavoring package is a mixture of flavor compounds which simulates the taste of cigarette smoke. One such material used herein was obtained from Firmenich of Geneva, Switzerland under the designation T69-22.

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 wt. percent. In the second step, this treated alumina was mixed with a combination of the other listed ingredients until the liquid was substantially absorbed within the alumina carrier.

D. Assembly

The capsule used to construct the FIG. 1 smoking article was prepared from deep drawn aluminum. The capsule had an average wall thickness of about 0.004 in. (0.01 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user. About 310 mg of the aerosol producing substrate described above was used to load the capsule. A fuel element prepared as above, was inserted into the open end of the filled capsule to a depth of about 3 mm.

E. Insulating Jacket

The fuel element—capsule combination was overwrapped at the fuel element end with a 10 mm long, glass fiber jacket of Owens-Corning 6437 (having a softening point of about 650° C.), with 3 wt. percent pectin binder, to a diameter of about 7.5 mm. The glass fiber jacket was then wrapped with an innerwrap material, a Kimberly Clark paper designated P780-63-5. The innerwrap had a basis weight of about 43 $gm/m^2$, a caliper of about 0.065 mm, and a Coresta porosity of about 8.0 cm/minute. The composition of the paper was about 70% hydrated bleached kraft pulp and 30% calcium carbonate.

F. Tobacco Jacket

A 7.5 mm diameter tobacco rod (28 mm long) with an overwrap of Kimberly-Clark Corporation's P1487-125 paper was modified by insertion of a probe to have a longitudinal passageway of about 4.5 mm diameter therein.

G. Assembly

The jacketed fuel element—capsule combination was inserted into the tobacco rod passageway until the glass fiber jacket abutted the tobacco. The glass fiber and tobacco sections were joined together by an outerwrap material which circumscribed both the fuel element/insulating jacket/innerwrap combination and the wrapped tobacco rod. The outerwrap was a Kimberly Clark paper designated P1768-65-2. It had a basis weight of about 42.5 g/m$^2$ and a Coresta porosity of about 13 cm/minute. The composition of the outerwrap was about 70% bleached kraft pulp, 8% attapulgite clay, 4% titanium dioxide, 18% microglass and contained about 5% by weight potassium succinate as a burn additive. A small amount of flavorant (less than about 0.1% by weight) was also added.

A mouthend piece of the type illustrated in FIG 1, was constructed by combining two sections; (1) a section of gathered Kimberly-Clark Corporation tobacco sheet material (10 mm long, 7.5 mm diameter) designated P144-185GAPF, overwrapped with Kimberly-Clark Corporation's P850-186-2 paper, adjacent the capsule, and (2) a section of meltblown thermoplastic polypropylene fiber, obtained from Kimberly-Clark Corporation designated PP-100-F, gathered into a 30 mm long, 7.5 mm diameter cylinder, and overwrapped with Kimberly-Clark Corporation's P1487-184-2. These two sections were combined with a combining overwrap of Kimberly-Clark Corporation's P850-186-2 paper.

The combined mouthend piece section was joined to the jacketed fuel element—capsule section by a final overwrap of Ecusta's 30637-801-12001 tipping paper.

Figure 5:
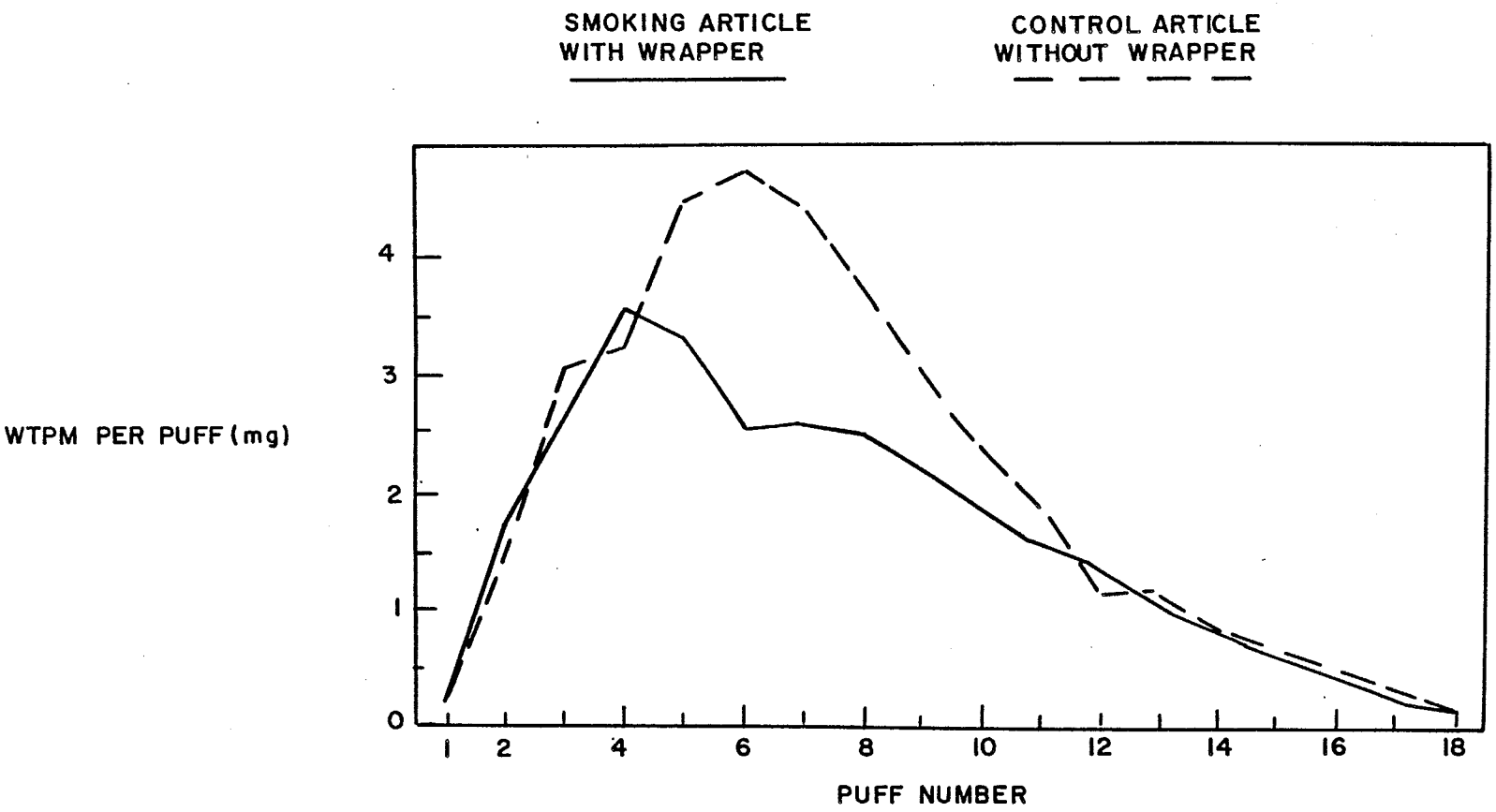
FIGS. 5–6 illustrate the WTPM delivery curves of smoking articles of Examples I–II as compared with similar articles constructed without the wrapper of the present invention.

Smoking articles thus prepared produced an aerosol resembling tobacco smoke without any undesirable off-taste due to scorching or thermal decomposition of the aerosol forming material. When such articles were smoked under the so-called human conditions described above, the WTPM in peak puffs was reduced by about 25% as compared with a smoking article having the same structure but without the innerwrap/outerwrap combination. This reduction of WTPM in peak puffs, as well as the resultant increase in puff count, is illustrated in FIG. 5.

EXAMPLE II

Smoking articles similar to those described in Example I were constructed in the following manner.

A. Fuel Element Preparation

Grand Prairie Canadian (GPC) Kraft paper made from hardwood and obtained from Buckeye Cellulose Corp., Memphis, TN, was shredded and placed inside a 9" diameter, 9" deep stainless steel furnace. The furnace chamber was flushed with nitrogen, and the furnace temperature was raised to 200° C. and held for 2 hours. The temperature in the furnace was then increased at a rate of 5° C. per hour to 350° C. and was held at 350° C. for 2 hours. The temperature of the furnace was then increased at 5° C. per hour to 650° C. to further pyrolize the cellulose. Again the furnace was held at temperature for 2 hours to assure uniform heating of the carbon. The furnace was then cooled to room temperature and the carbon was ground into a fine powder (less than 400 mesh) using a "Trost" mill. This powdered carbon (CGPC) had a tapped density of 0.6 grams/cubic centimeter and hydrogen plus oxygen level of 4%.

Nine parts of this carbon powder was mixed with one part of SCMC powder, $K_2CO_3$ was added at 1 wt. percent, and water was added to make a thin slurry, which was then cast into a sheet and dried. The dried sheet was then reground into a fine powder and sufficient water was added to make a plastic mix which was stiff enough to hold its shape after extrusion, e.g., a ball of the mix will show only a slight tendency to flow in a one day period. This plastic mix was then loaded into a room temperature batch extruder. The female extrusion die for shaping the extrudant had tapered surfaces to facilitate smooth flow of the plastic mass. A low pressure (less than 5 tons per square inch or $7.03\times10^6$ kg per square meter) was applied to the plastic mass to force it through a female die of 4.6 mm diameter. The wet rod was then allowed to dry at room temperature overnight. To assure that it was completely dry it was then placed into an oven at 80° C. for two hours. This dried rod had an apparent (bulk) density of about 0.9 g/cc, a diameter of 4.5 mm, and an out of roundness of approximately 3%.

The dry, extruded rod was cut into 10 mm lengths and seven 0.5 mm holes were drilled through the length of the rod.

B. Assembly

The metallic containers for the substrate were 30 mm long spirally wound aluminum tubes obtained from Niemand, Inc., having a diameter of about 4.5 mm. One end of each of these tubes was crimped to form an end with a small hole. Approximately 180 mg of PG-60, a granulated graphite, was used to fill each of the containers. This substrate material was loaded with approximately 75 mg of a 1:1 mixture of glycerin and propylene glycol. After the metallic containers were filled, each was joined to a fuel rod by inserting about 2 mm of the fuel rod into the open end of the container. Each of these units was then joined to a 35 mm long polypropylene tube of 4.5 mm internal diameter by inserting one end of the tube over the walled end of the container.

Each of these core units was placed on a sheet of Manniglas 1200 pretreated at about 600° C. for up to about 15 min. in air to eliminate binders, and rolled until the article was approximately the circumference of a cigarette. An additional double wrap of Manniglas 1000 was applied around the Manniglas 1200.

The ceramic fiber jacket was cut away from 10 mm of the mouth end of the polypropylene tube so that a 10 mm long annular segment of cellulose acetate filter material could be placed over the polypropylene tube. The mouth end of this segment was heavily coated with a conventional adhesive to block air flow through the filter material. A conventional cellulose acetate filter plug of 10 mm length was butted against the adhesive.

The ceramic jacket was encircled by a layer of nonporous, nonburning, experimental mica paper obtained from Corning Glass Works, Corning NY and believed to be prepared in accordance with the teachings of U.S. Pat. No. 4,297,139. This paper was provided with twenty-one 3/32 inch diameter holes in the 10 mm long area around the fuel element to afford about 48% open area around the fuel element. A paper punch which removed the punched-out material was used to provide the open area. The entire article was then wrapped with ECUSTA 01788 perforated cigarette paper, and a conventional tipping paper was applied to the mouth end.

Figure 6:
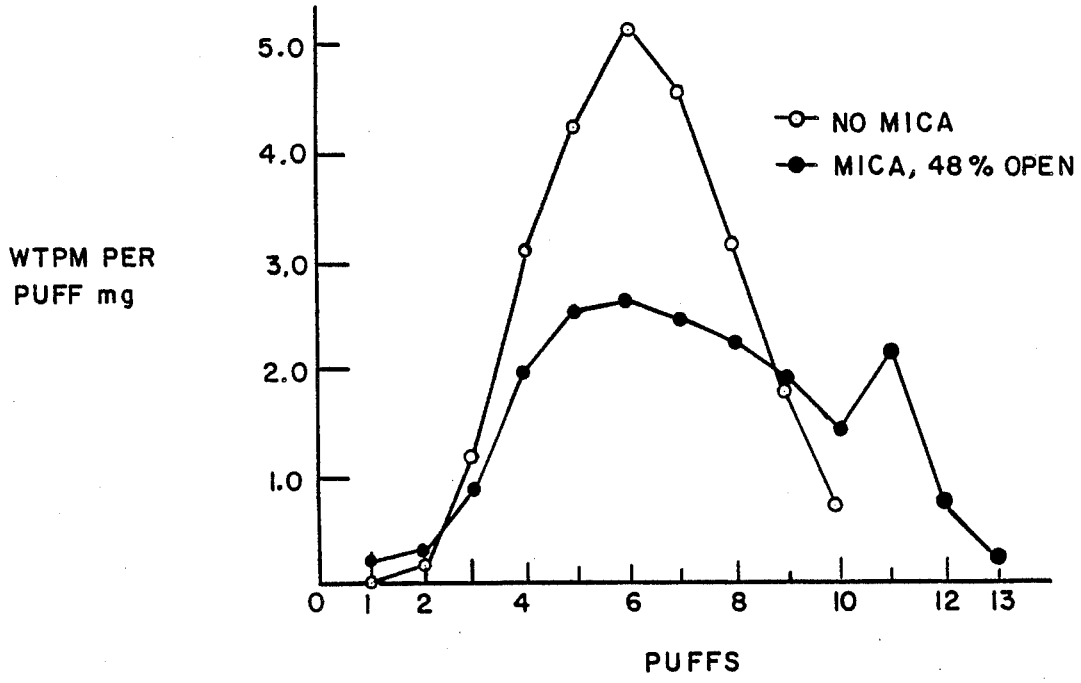

Several of these articles were smoked under human conditions consisting of a 50 ml puff volume of 2 second duration, separated by 28 seconds of smolder As can be seen from FIG. 6, there was a significant reduction in WTPM in peak puffs of about 50%.

Similar results were obtained when other stable barrier materials, such as heavy duty aluminum foil, and high temperature plastic film such as 1 mil Kapton and 2 and 3 mil Nomex which were substituted for the mica paper and provided with an open area of about 48%.

What is claimed is:

1. An improved wrapper for a smoking article having a combustible fuel element encircled at least in part by an air permeable insulating layer and a physically separate aerosol generating means including an aerosol forming material, the wrapper encircling at least a portion of the insulating layer, and comprising a material which during burning of the fuel element provides a permeable coherent layer to assist in controlling the amount of peripheral air to the burning fuel element, wherein the wrapper reduces the peak puff aerosol delivery when measured as wet total particulate matter by at least about 20% when compared to a smoking article having the same structure but without the wrapper, when the smoking articles are smoked under conditions which consist of 50 ml puff volumes of 2 seconds duration, separated by 28 seconds of smolder, for at least six puffs.

2. The improved wrapper of claim 1, wherein the wrapper reduces the peak puff aerosol delivery when measured as wet total particulate matter by at least 35%.

3. The improved wrapper of claim 1, wherein the wrapper reduces the peak puff aerosol delivery when measured as wet total particulate matter by at least 50%.

4. The improved wrapper of claim 1, wherein the wrapper comprises a sufficient amount of inorganic material to provide the coherent layer.

5. The improved wrapper of claim 4, wherein the inorganic material comprises a perforated aluminum sheet.

6. A cigarette-type smoking article comprising:
(a) a fuel element;
(b) a physically separate aerosol generating means including at least one aerosol forming material;
(c) an air permeable insulating layer which encircles at least a portion of the fuel element; and
(d) a wrapper which at least partially encircles the insulating layer comprising a permeable sheet material which provides a coherent permeable layer during burning of the fuel element to assist in controlling the amount of peripheral air to the burning fuel element.

7. The smoking article of claim 6, wherein the sheet material reduces the peak puff aerosol delivery when measured as wet total particulate matter by at least about 20% when compared to a smoking article having the same structure but without the wrapper, when the smoking articles are smoked under conditions which consist of 50 ml puff volumes of 2 seconds duration, separated by 28 seconds by smolder, for at least six puffs.

8. The smoking article of claim 7, wherein the sheet material reduces the peak puff aerosol delivery when measured as wet total particulate matter by at least about 35%.

9. The smoking article of claim 7, wherein the sheet material reduces the peak puff aerosol delivery when measured as wet total particulate matter by at least about 50%.

10. The smoking article of claim 6, wherein the amount of peripheral air to the burning fuel element is sufficient to deliver at least about 0.8 mg per puff of wet total particulate matter when the smoking article is smoked under standard FTC conditions, for at least six puffs.

11. The smoking article of claim 6, wherein the fuel element is carbonaceous.

12. The smoking article of claim 11, wherein the fuel element is less than about 30 mm in length and has a diameter less than about 8 mm.

13. The smoking article of claim 11, wherein the aerosol generating means is in a conductive heat exchange relationship with the fuel element.

14. The smoking article of claim 6, wherein the insulating layer is at least about 0.5 mm thick.

15. The smoking article of claim 11, further comprising a heat conducting member, which member contacts at least a portion of the fuel element and at least a portion of the aerosol generating means.

16. The smoking article of claim 6, wherein the wrapper comprises a sufficient amount of inorganic material to provide the coherent layer.

17. The smoking article of claim 16, wherein the inorganic material comprises glass fibers.

18. The smoking article of claim 17, wherein, during burning, the glass fibers fuse to form the coherent ash.

19. The smoking article of claim 16, wherein the inorganic material comprises a perforated aluminum sheet.

20. A cigarette-type smoking article comprising:
(a) a fuel element;
(b) a physically separate aerosol generating means including at least one aerosol forming material;
(c) an air permeable insulating layer which encircles at least a portion of the fuel element; and
(d) a wrapper which at least partially encircles the insulating layer comprising a permeable sheet material which remains coherent when burned to reduce the peak puff aerosol delivery when measured as wet total particulate matter by at least about 20% when compared to a smoking article having the same structure but without the wrapper, when the smoking articles are smoked under conditions which consists of 50 ml puff volumes of 2 seconds duration, separated by 28 seconds of smolder, for at least six puffs.

21. A cigarette-type smoking article comprising:
(a) a fuel element;
(b) a physically separate aerosol generating means including at least one aerosol forming material;
(c) an air permeable insulating layer encircling at least a portion of the fuel element; and
(d) a wrapper which at least partially encircles a portion of the insulating layer comprising:
(i) an innerwrap which, upon lighting of the fuel element, burns to produce a high permeability non-coherent ash; and
(ii) an outerwrap which comprises a permeable sheet material which provides a coherent permeable layer during burning of the fuel element to assist in controlling the amount of peripheral air to the burning fuel element.

22. The smoking article of claim 21, wherein the coherent nature of the outerwrap is provided by including as a component of the outerwrap a sufficient amount of inorganic material, which during burning of the fuel element forms a coherent ash.

23. The smoking article of claim 22, wherein the inorganic material comprises glass fibers.

24. The smoking article of claim 23, wherein, during burning, the glass fibers fuse to form the coherent ash.

25. The smoking article of claim 21, wherein the wrapper reduces the peak puff aerosol delivery when measured as wet total particulate matter by at least about 20% when compared to a smoking article having the same structure but without the wrapper, when the smoking articles are smoked under conditions which consist of 50 ml puff volumes of 2 seconds duration, separated by 28 seconds of smolder, for at least six puffs.

26. The smoking article of claim 25, wherein the wrapper reduces the peak puff aerosol delivery when measured as wet total particulate matter by at least about 35%.

27. The smoking article of claim 25, wherein the wrapper reduces the peak puff aerosol delivery when measured as wet total particulate matter by at least about 50%.

28. The smoking article of claim 21, wherein the amount of peripheral air to the burning fuel element is sufficient to deliver at least about 0.8 mg per puff of wet total particulate matter when the smoking article is smoked under standard FTC conditions, for at least six puffs.

29. The smoking article of claim 21, wherein the fuel element is carbonaceous.

30. The smoking article of claim 29, further comprising a heat conducting member, which member contacts at least a portion of the fuel element and at least a portion of the aerosol generating means.

31. The smoking article of claim 29, wherein the fuel element is less than about 30 mm in length and has a diameter less than about 8 mm.

32. The smoking article of claim 29, wherein the aerosol generating means is in a conductive heat exchange relationship with the fuel element.

33. The smoking article of claim 21, wherein the insulating layer is at least about 0.5 mm thick.

34. The smoking article of claim 21, 22, 23, 25, 26, 27, 24, 28, 29, 31, 32, 33 or 30, wherein the wrapper is treated with a burn additive.

35. The smoking article of claim 34, wherein the amount of burn additive by weight percent of the wrapper is less than about 10.

36. The smoking article of claim 34, wherein the amount of burn additive by weight percent of the innerwrap is in the range between about 1.0 and 6.0.

37. The smoking article of claim 36, wherein the amount of burn additive by weight percent of the innerwrap is in the range between about 2.5 and 4.5.

38. The smoking article of claim 34, wherein the amount of burn additive by weight percent of the outerwrap is in the range between about 5.0 and 7.5.

39. The smoking article of claim 38, wherein the amount of burn additive by weight percent of the outerwrap is in the range between about 6.0 and 6.5.

40. The smoking article of claim 34, wherein the burn additive is an alkali metal salt selected from the group consisting of sodium citrate, potassium citrate, sodium succinate or potassium succinate.

41. The smoking article of claim 21, 22, 23, 25, 26, 27, 24, 28, 29, 31, 32, 33 or 30, wherein the composition of the outerwrap comprises 40 to 80% cellulose fibers, about 10 to 30% high temperature resistant glass fibers, and about 10 to 30% mineral filler.

42. The smoking article of claim 41, wherein the mineral filler comprises about 5 to 15% attapulgite clay and less than about 10% titanium dioxide.

* * * * *